US005187335A

United States Patent [19]

Fukuyama et al.

[11] Patent Number: 5,187,335

[45] Date of Patent: Feb. 16, 1993

[54] SWITCH WITH INTERLOCKED OPERATORS

[75] Inventors: Takahiko Fukuyama, Mino; Satosi Kozawa, Ichinomiya; Kazuyoshi Ishiguro; Toshiki Akita, both of Nagoya; Seiji Hori, Aichi, all of Japan

[73] Assignee: Kabushiki Kaisha Tokai Rika Denki Seisakusho, Aichi, Japan

[21] Appl. No.: 657,840

[22] Filed: Feb. 19, 1991

[30] Foreign Application Priority Data

Feb. 23, 1990 [JP] Japan ..... 2-17592[U]

[51] Int. Cl.[5] ..... H01H 9/20; H01H 13/56

[52] U.S. Cl. ..... 200/5 B; 200/5 E; 200/50 C; 200/524

[58] Field of Search ..... 200/5 B, 5 C, 5 D, 5 E, 200/50 C, 523, 524

[56] References Cited

U.S. PATENT DOCUMENTS 3,260,802 7/1966 Yamauchi et al. ..... 200/5 B
4,297,540 10/1981 Tsutsui et al. ..... 200/5 B
4,531,026 7/1985 Terajima et al. ..... 200/524 X
4,575,590 3/1986 Hattori et al. ..... 200/5 B
4,692,573 9/1987 Fukuyama et al. ..... 200/50 C
4,843,192 6/1989 Kamada et al. ..... 200/524 X

FOREIGN PATENT DOCUMENTS 57-99329 5/1982 Japan .
2-104535 8/1990 Japan .

*Primary Examiner*—J. R. Scott
*Attorney, Agent, or Firm*—Finnegan, Henderson, Farabow, Garrett and Dunner

[57] ABSTRACT

The switch includes a case, first and second manipulation members, two switching mechanisms, cam projections two locking members, guide grooves, and an operating member. The guide grooves for guiding the locking members are arranged so that tip ends of the locking members can be put in contact with the operation member for forcibly returning the manipulation members from a pressed-in position to a released position and that the tip ends are prevented from facing the operation member when the tip ends are located in a normal paths of the guide grooves, thereby preventing deformation of locking members and damages of the cam projections due to an erroneous pressing operation.

10 Claims, 8 Drawing Sheets

SWITCH WITH INTERLOCKED OPERATORS

BACKGROUND OF THE INVENTION

1. Field of the Invention

The present invention relates to a switch in which two switching mechanisms are separately put into action by manipulation members.

2. Description of the Prior Art

In a conventional push-button switch, a plurality of switching mechanisms are each provided with two push buttons. When the first push button is held in a pressed-in position and is to be returned to the original position thereby putting the switching mechanism out of action, a second push button exclusively for the return the switching mechanism is pressed to operate a cancellation plate to remove the first push button from the pressed-in position. If the second push bottom is pressed in as the first remains held in the pressed-in position, the cancellation plate is operated in kinematic conjunction with the second push button to remove the first push button from the pressed-in position, to prevent two switching mechanisms from being simultaneously put into action. However, there is a drawback that a push button required exclusively to return the switching mechanism is needed and may take up a large amount of space. If the push required exclusively to return the switching mechanism were not provided, one of the other push buttons would be always held in the pressed-in position so that all of the switching mechanisms could not be simultaneously put out of action.

To eliminate the drawback, the Japanese Utility Model Unexamined Publication No. Sho. 57-99329 (assigned to the present assignee) discloses a switch in which a manipulation member exclusively for return is not needed, it is unlikely that two switching mechanisms would to be simultaneously put into action, and all switching mechanisms can be simultaneously put out of action.

DESCRIPTION OF THE RELATED ART

Also, in order to eliminate the drawback, the Japanese Utility Model Unexamined Publication No. Hei. 2-104535 (assigned to the present assignee) discloses a switch in which a manipulation member required exclusively to return the switching mechanism is not needed, it is unlikely that two switching mechanisms would to be simultaneously put into action, and all switching mechanisms can be simultaneously put out of action.

The switch disclosed in the above Publication No. Hei. 2-104535, which is a related art of the present invention and not a prior art thereof, includes a body 1 as a casing, and a cylindrical case 2 fitted on the outside of the body, as shown in FIGS. 10 and 11. The interior of the body 1 is divided into two sections by a partition wall 1*a*. A first and a second manipulation member 3 and 4 is slidably supported in each section, and each is urged forward by a compressed helical spring 5, so that the manipulation members can be pressed in backward against the springs by push buttons 6 and 7 fitted in the front ends of the sections. The switch also includes holding mechanisms 8 and 9 for holding the manipulation members 3 and 4 in pressed-in positions. The holding mechanisms 8 and 9 are shaped symmetrically to each other about the partition wall 1*a*. Each of the holding mechanisms 8 and 9 includes a locking member 10 made of a spring wire and disposed in the body 1, and a cam projection 11 formed on a side of the corresponding manipulation member 3 or 4.

The holding mechanism 9 provided for the second manipulation member 4 will now be described in detail with reference to FIG. 11. The cam projection 11 is disposed nearly at the center of a recess 12 provided in the side of the second manipulation member 4. A surface 13 is recessed in the side of the second manipulation member 4 near the engagement surface 11*a* of the cam projection 11. The surface 13 is recessed less than the bottom of the recess 12 and is connected to that bottom by a slope 14. The holding mechanisms 8 and 9 are symmetrical to each other in constitution and operation. The coiled portion 10*a* of the locking member 10 is fitted on the projection 1*b* of the body 1. The tip portion 10*b* of the locking member 10 is bent as in an L shape. The bent tip portions 10*b* of the locking members 10 of both the holding mechanisms 8 and 9 are always urged in directions shown by arrows A and B due to the resilient forces of the members so that the bent tip portions are in resilient contact with the inside surfaces of the recesses 12 under the cam projections 11 when the push buttons 6 and 7 are not pressed in. When the manipulation member 4 is pressed in, the bent tip portion 10*b* of the locking member 10 is slid along the edge of the surface 13 as shown by arrow a in FIG. 11. When the pressing in of the manipulation member 4 is then ceased, the bent tip portion 10*b* of the locking member 10 moves up on the slope 14 as shown by arrow b in FIG. 11 and is finally engaged with the engagement surface 11*a* of the cam projection 11 near the slender portion 11*b* thereof so that the manipulation member 4 is held in the pressed-in position. When the manipulation member 4 is thereafter slightly pressed backward from the pressed-in position, the bent tip portion 10*b* of the locking member 10 is disengaged from the engagement surface 11*a* of the cam projection 11 so that the manipulation member is released from being held in the pressed-in position. Then, by the force of the compressed helical spring 5, the manipulation member 4 is moved forward. At that time, the bent tip portion 10*b* slides in a groove 13*a* disposed about a portion of the surface 13 as shown by arrow c, so that the bent tip portion 10*b* returns to the original position where the portion 10*b* is in resilient contact with the inside surface of the recess 12 under the cam projection 11. The movement of the locking member 10 of the holding mechanism 8 at the time of the pressing-in of the first manipulation member 3 is symmetrical to that of the locking member 10 of the holding mechanism 9 at the time of the pressing-in of the second manipulation member 4. Each locking member 10 thus holds the corresponding manipulation member 3 or 4 in the pressed-in position or ceases the holding, alternately, every time the manipulation member is pressed.

The switch shown in FIGS. 10 and 11 also includes a nearly fan-shaped operating member 15 swingable about a pin 16 projecting from the body 1 and having contact end portions 15*a* facing the locking members 10 near the bent tip portions 10*b* thereof. In the state that the push buttons 6 and 7 are not pressed in as shown in FIG. 10, the bent tip portions 10*b* are in contact with the recess 12 and located under the operating member 15. The sides of the o manipulation members 3 and 4 have contact projections 17 located near the cam projections 11 and opposing the oblique portions 15*b* of the operating member 15, which extends to the contact end portions 15*a* thereof. When the first manipulation member 3 is pressed in by the push button 6, the operating member 15 is swung in a direction shown by arrow E. When the second manipulation member 4 is pressed in by the other push button 7, the operating member 15 is swung in a direction reverse to the former direction shown by arrow E.

When the manipulation member 4 held in the pressed-in position is slightly pressed backward, the bent tip portion 10*b* of the locking member 10 is disengaged from the engagement surface 11*a* of the cam projection 11 near the slender portion 11*b* thereof so that the manipulation member is released from the pressed-in position, and is then moved forward by the force of the compressed helical spring 5. At that time, the bent tip portion 10*b* slides in the groove 13*a* on the surface 13 as shown by the arrow c in FIG. 11, so that the bent tip portion 10*b* returns to the original position thereof. However, if the other manipulation member 3 is pressed in by mistake as the bent tip portion 10*b* of the locking member 10 is in the groove 13*a*, resultingly both the manipulation are simultaneously pressed in. The operating member 15 is thus swung in the direction shown by arrow E so that the bent tip portion 10*b* in the groove 13*a* is pushed in direction the shown by arrow e by one of the contact end portions 15*a* of the operating member as shown in FIG. 11. For that reason, the locking member 10 and the cam projection 11 are likely to be both undesirably overloaded so that the locking member is plastically deformed and/or the slender portion 11*b* of the projection is damaged.

SUMMARY OF THE INVENTION

The present invention was made in order to solve the problems mentioned above.

Accordingly, it is an object of the present invention to provide a switch in which a manipulation component required exclusively to return a given switching mechanism is not needed; two switching mechanisms are prevented from being simultaneously put into action; all switching mechanisms can be simultaneously put out of action; and locking members are not plastically deformed and/or cam projections are not damaged even if manipulation members are simultaneously pressed in.

The switch comprises a case, first and second manipulation members, two switching mechanisms, cam projections, two locking members, guide grooves, and an operating member. The manipulation members are juxtaposed with each other in the case so that the manipulation members can be pressed. The first and the second manipulation members are urged, by urging means, in direction reverse to that of the pressing of the members. The switching mechanisms are separately put into action by pressing the manipulation members. The cam projections are provided on the sides of the manipulation members. The locking members are provided in the case so that the locking members correspond to the manipulation members, and each of the locking members can be swung to be engaged with the corresponding cam projection to hold the corresponding manipulation member in a pressed-in actuated position, or to be disengaged from the cam projection to cease the holding, alternately. The guide grooves are provided around the cam projections so as to engage and disengage the tip portions of the locking members with and from the cam projections. The operating member is displaced in response to the pressing of each of the manipulation members so as to come into contact with the tip portion of the corresponding locking member to swing the locking member to forcibly return it into a nonholding state without normal operation for the cessation of the holding of the manipulation member. Each of the guide grooves is shaped so that the tip portion of the corresponding locking member is located to be capable of being put into contact with the operating member when the locking member is engaged with the corresponding cam projection and that the tip portion does not contact the operating member when the tip portion is located in a normal path extending between the position of the engagement of the tip portion with the cam projection and that of the disengagement of the tip portion from the cam projection.

Each of the locking members holds the first or second manipulation member in the pressed-in actuated position or the released position, alternately, every time the manipulation member is pressed. For that reason, releasing the manipulation member from being held in the pressed-in position can be performed by pressing the member. Therefore, the manipulation component required exclusively for returning the manipulation member to the original release position from the pressed-in position is not needed, so that the switch can be made compact. Besides, although the manipulation component exclusively required to return the manipulation member is not provided, all the manipulation members can be simultaneously returned to the original positions from the pressed-in positions so as to simultaneously put all the switching mechanisms out of action. When one of the manipulation members is pressed as the other remains held in the pressed-in position, the operating member is displaced to swing the locking member for the latter manipulation member so as to cease holding the latter manipulation member. For that reason, the two switching mechanisms are not simultaneously put into action. This results in always properly operating an electric appliance connected to the switch. Since the guide grooves are shaped as described above, the locking members are not plastically deformed and/or the cam projections are not damaged even if the manipulation members are simultaneously pressed in.

DETAILED DESCRIPTION OF THE PREFERRED EMBODIMENTS

An embodiment of the present invention is hereafter described in detail with reference to the drawings attached hereto.

Figure 8:
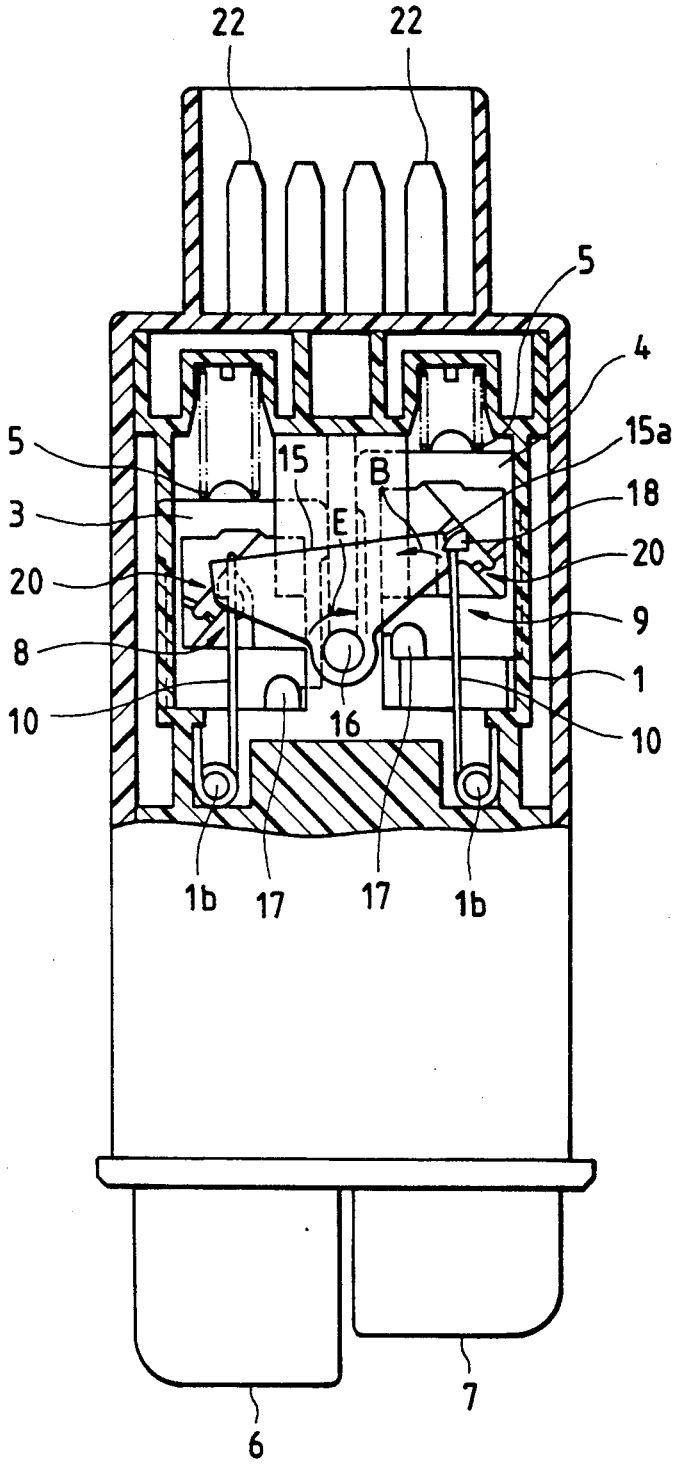
Figure 9:
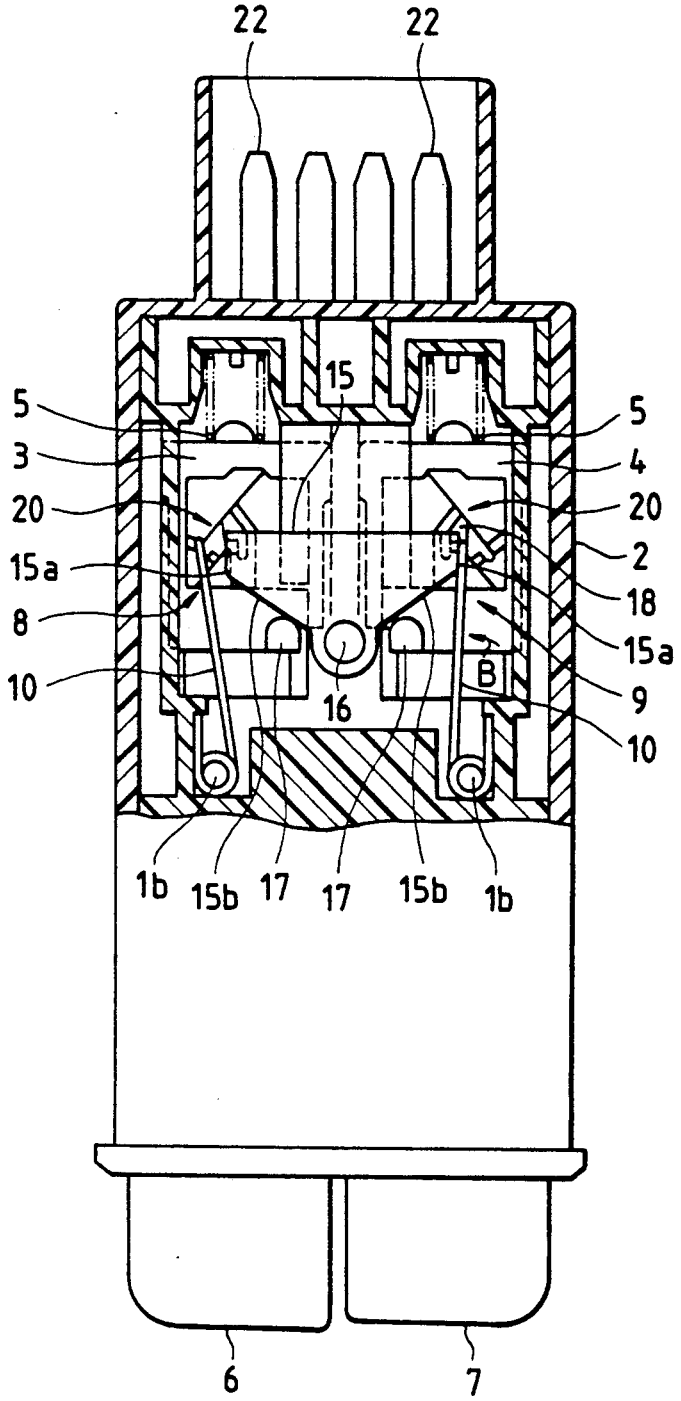
Figure 10:
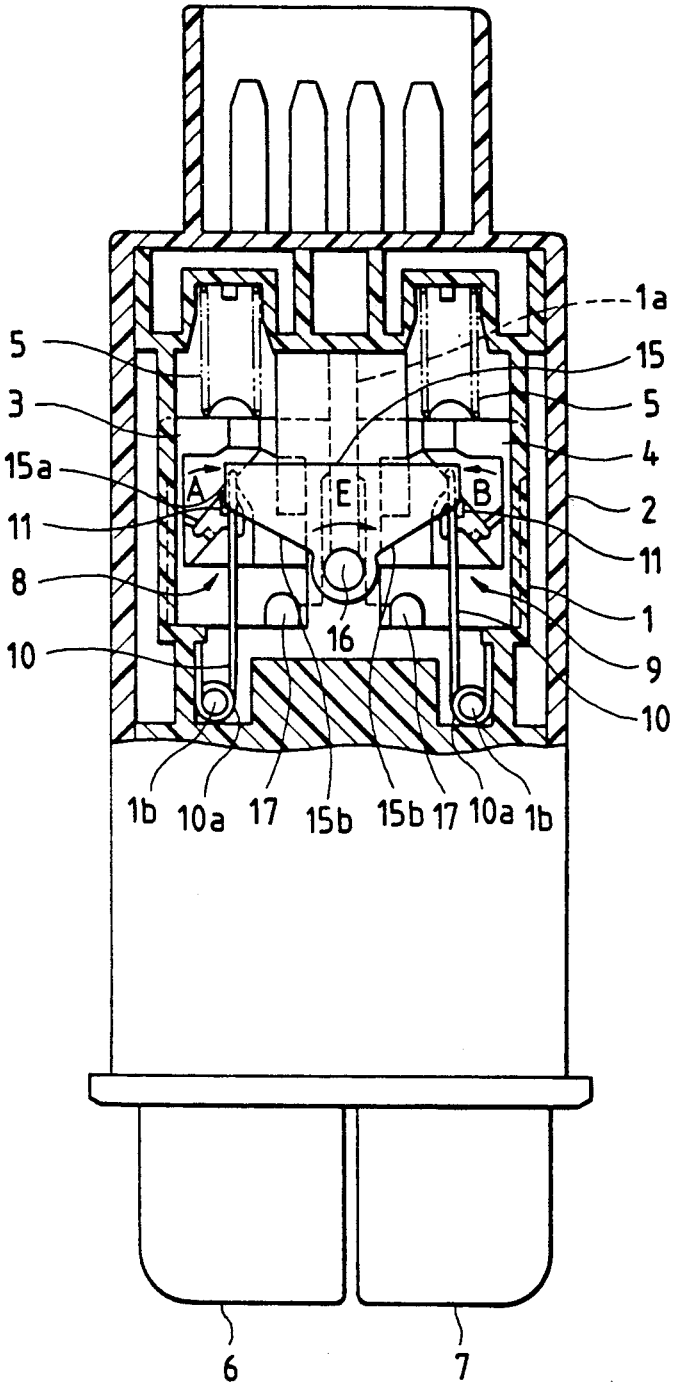
FIG. 10 is a partial sectional plan view showing a switch which is a related embodiment of the present invention
Figure 11:
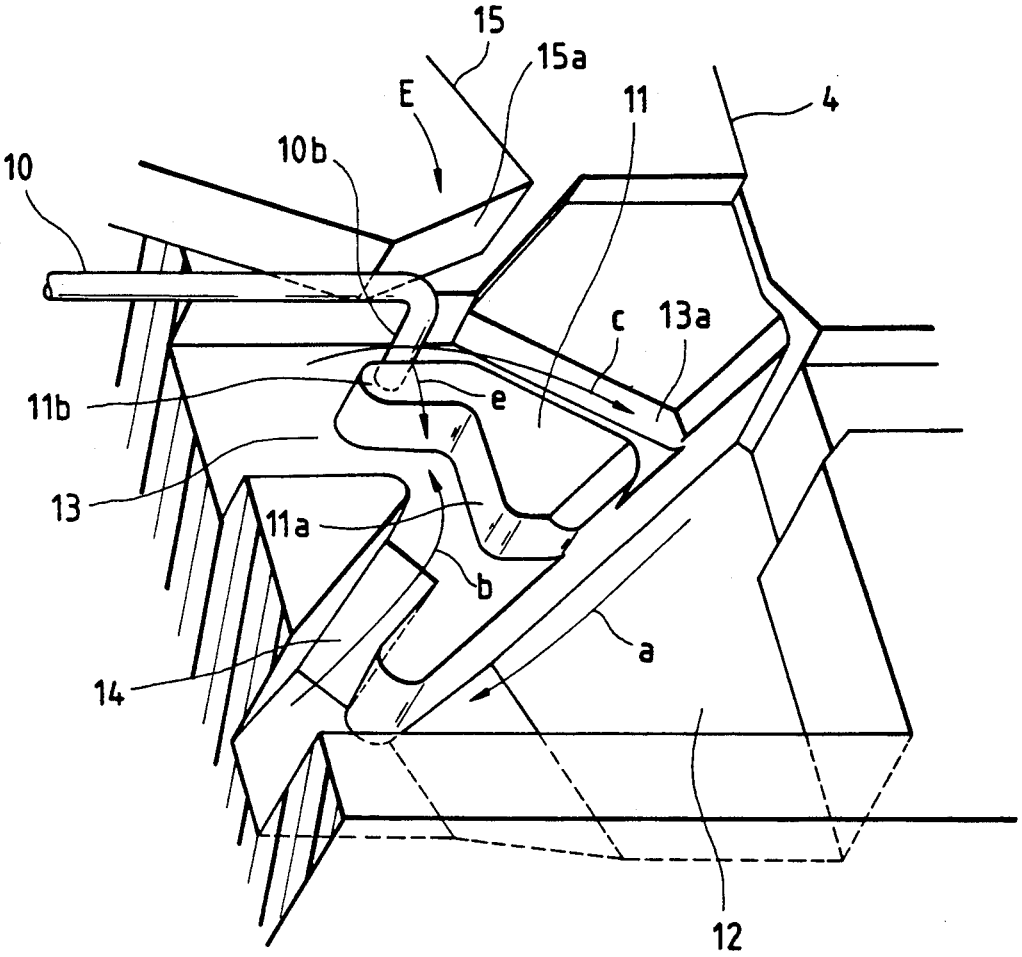
FIG. 11 is an enlarged perspective view showing a major part of the switch shown in FIG. 10.

FIGS. 1–9 embodying the present invention show a switch. The portions of the switch, which are equivalent to those of the conventional switch shown in FIGS. 10 and 11, are denoted by the same reference symbols as the latter and not described in detail hereinafter. Therefore, only the other portions of the switch which is the embodiment are described in detail hereinafter.

Figure 4:
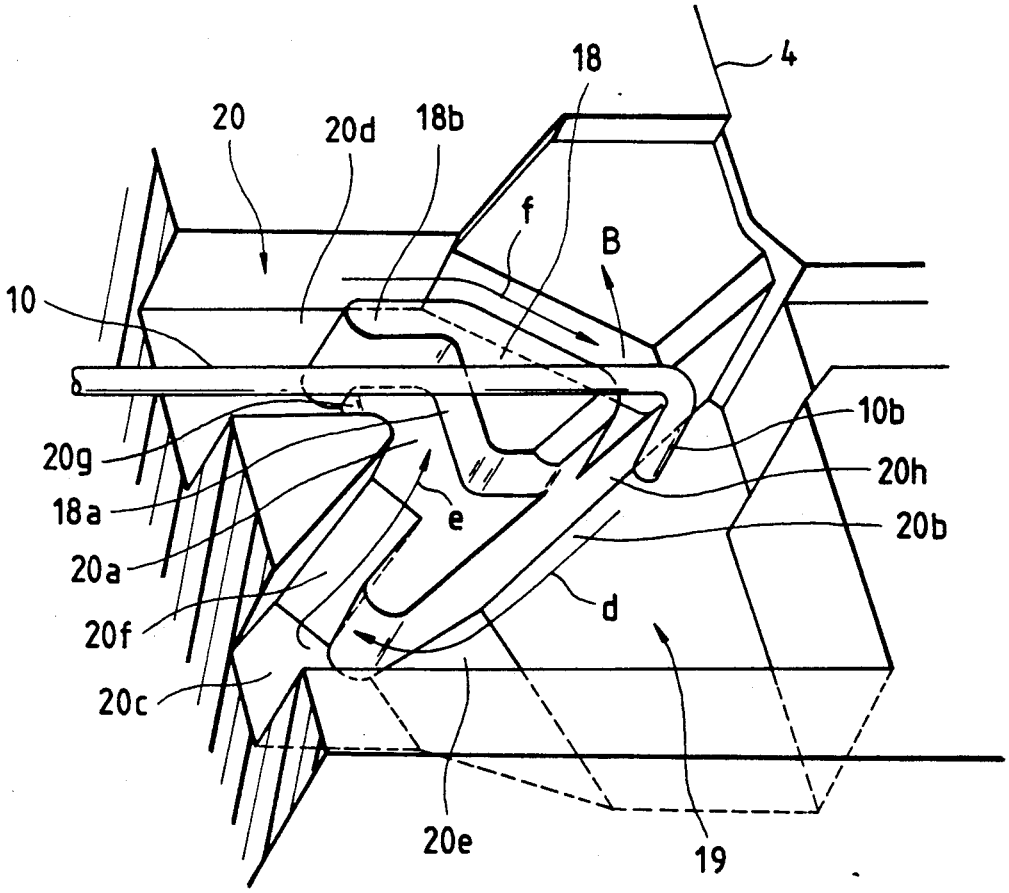
FIG. 4 is an enlarged perspective view showing a major part of the switch.
Figure 5:
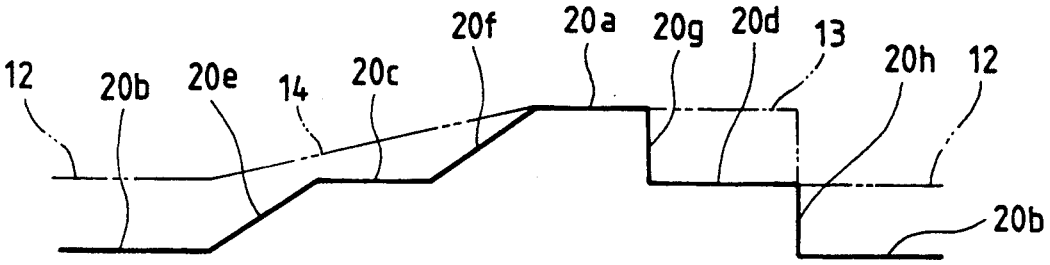
FIG. 5 is an enlarged sectional view showing the switch along the guide groove thereof and indicating the change in the depth of the groove.

One side of each of the manipulation members 3 and 4 of the switch which is the embodiment has a cam projection 18 instead of the cam projection 11 of the conventional switch. The cam projection 18 provided on the side of the second manipulation member 4 will be described in detail with reference to FIG. 4. The cam projection 18 is located nearly at the center of the recess 19 of the side of the second manipulation member 4, and includes an engagement surface 18*a*, with which the bent tip portion 10*b* of the locking member 10 of the switch is engaged when the push button 7 is pressed in, and a slender portion 18*b* which is adjacent to the engagement surface and acts so that the bent tip portion 10*b* engaged with the engagement surface is prevented from swinging in a direction shown by arrow B. The recess 19 includes a guide groove 20 extending around the cam projection 18 so as to guide the bent portion 10*b* of the locking member 10. As shown in FIG. 4, the guide groove 20 has a surface 20*a* adjacent to the engagement surface 18*a* of the cam projection 18, another surface 20*b*, which is recessed into the second manipulation member 4 deeper than the surface 20*a* and which is contacted by the bent portion 10*b* of the locking member 10 when the push button 7 is not pressed in. The guide groove 20 has another surface 20*c* extending between the surfaces 20*a* and 20*b* and recessed into the second manipulation member 4 deeper than the surface 20*a* but smaller in depth than the surface 20*b*. The guide groove 20 has yet another surface 20*d* extending between the surfaces 20*a* and 20*b* and recessed into the second manipulation member 4 deeper than the surface 20*a* and shallower than the surface 20*b*. The guide groove 20 also has a slope 20*e* coupling the surfaces 20*b* and 20*c* to each other, another slope 20*f* coupling the surfaces 20*a* and 20*c* to each other, a wall surface 20*g* coupling the surfaces 20*a* and 20*d* to each other, and another wall surface 20*h* coupling the surfaces 20*b* and 20*d* to each other. The holding mechanism 9 of the switch includes the locking member 10 and the cam projection 18 and is for the push button 7. The other holding mechanism 8 of the switch is for the other push button 6 thereof and is symmetrical in constitution and operation to the former holding mechanism 9.

Figure 1:
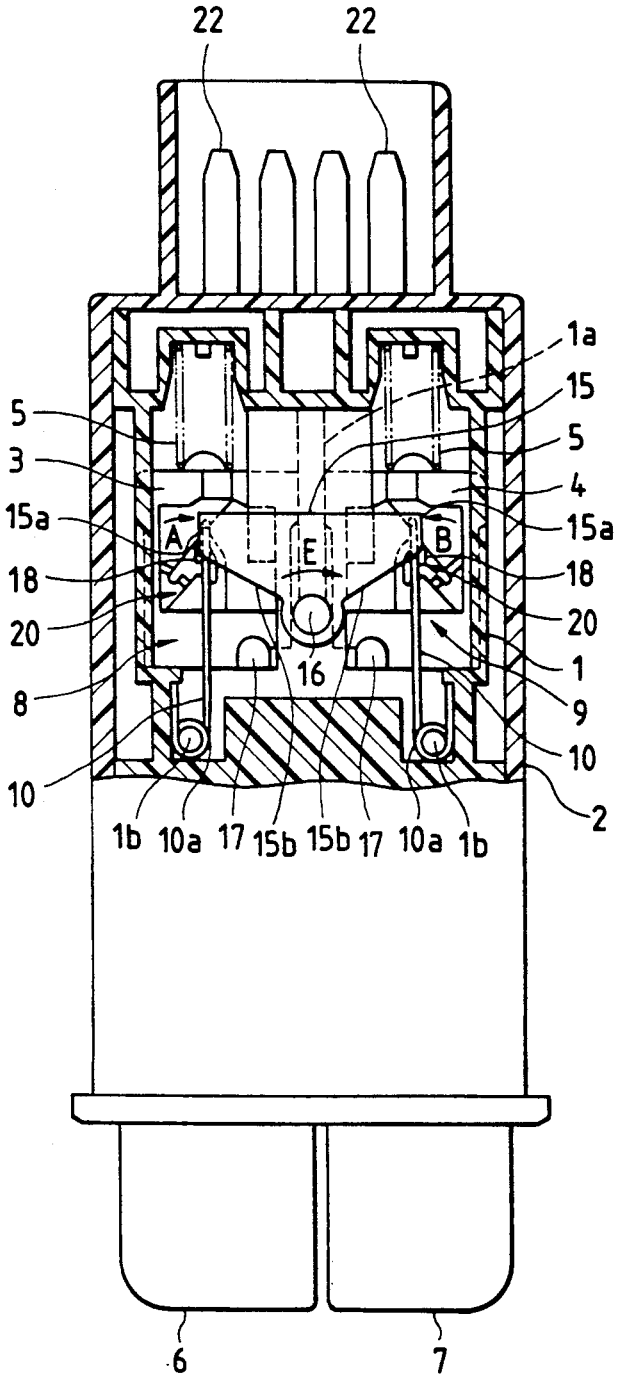
FIG. 1 is a partial a partial sectional plan view showing a switch according to an embodiment of the present invention.
Figure 2:
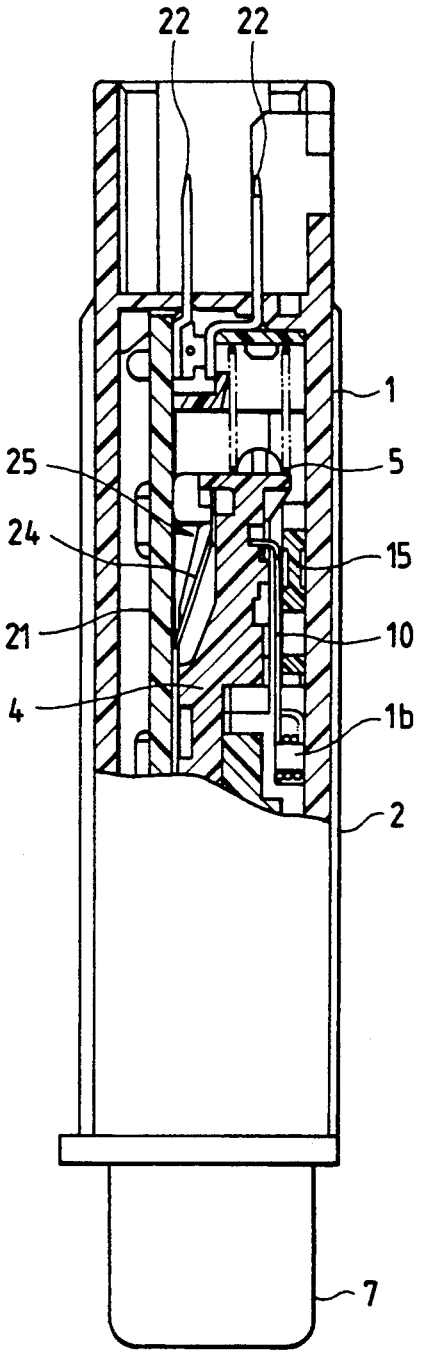
FIG. 2 is a partial sectional side view showing the switch.

When the second manipulation member 4 is pressed in, the bent portion 10*b* of the locking member 10 is slid along the edge of the surface 20*b*, i.e. along the wall surface 20*h as* shown by an arrow d in FIG. 4 and then reaches the surface 20*c* via 20*e*. When the pressing in of the manipulation member 4 is then ceased, the bent portion 10*b* of the locking member 10 is moved to the surface 20*a* via along the slope 20*f* as shown by an arrow e in FIG. 4. The bent portion 10*b* is then engaged with the engagement surface 18*a* of the cam projection 18 near the slender portion 18*b* thereof so that the second manipulation member 4 is held in a pressed-in position. When the second manipulation member 4 held in the pressed-in position is slightly pressed backward, the bent portion 10*b* of the locking member 10 is disengaged from the slender portion 18*b* of the cam projection 18 so that the manipulation member is released from being held in the pressed-in position and is then moved forward by the force of a compressed helical spring 5. At that time, the bent portion 10*b* of the locking member 10 slides along the wall surface 20*g*, the surface 20*d* and the other wall surface 20*h* in that order as shown by an arrow f in FIG. 4, so that the bent portion returns to the original position on the surface 20*b*. The movement of the locking member 10 for the first manipulation member 3 during pressing-in is symmetrical to that of the locking member 10 for the second manipulation member 4 during pressing-in. The locking member 10 thus holds the corresponding manipulation member 3 or 4 in the pressed-in position or ceases the holding, alternately, every time the manipulation member is pressed. When each of the push buttons 6 and 7 is not pressed in as shown in FIG. 1, the bent tip portion 10*b* of the corresponding locking member 10 is located under the operation member 15 of the switch.

Figure 6:
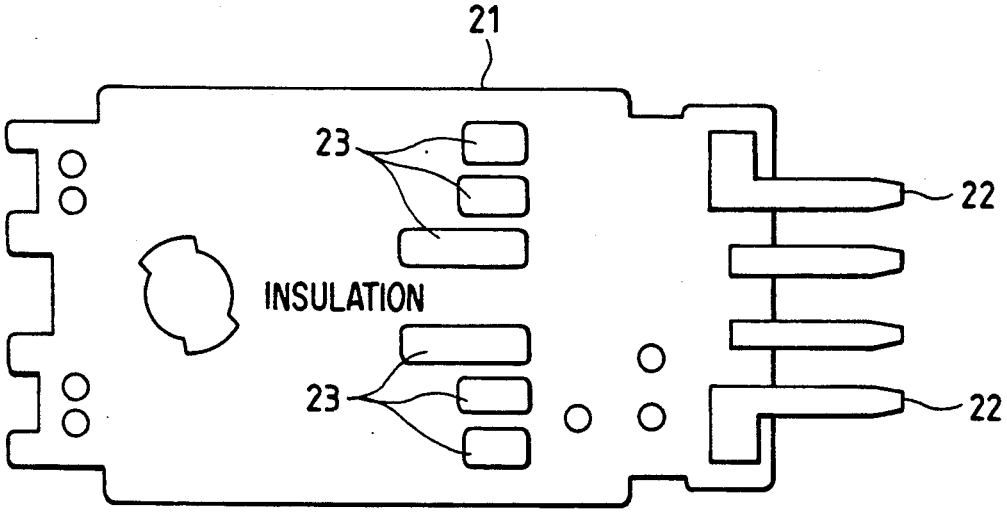
FIG. 6 is a bottom view showing the electric insulator of the switch.

The switch includes an electric insulator 21 mounted in the body 1 of the switch. As shown in FIG. 6, connectors 22 and fixed contacts 23 electrically connected thereto are provided in appropriate positions on the side of the insulator 21, which faces the manipulation members 3 and 4. Movable contacts 24 made of plate springs are provided on the manipulation members 3 and 4 so that the movable contacts are selectively put into and out of touch with the fixed contacts 23 as the manipulation members are moved. The fixed and the movable contacts 23 and 24 comprise two switching mechanisms 25 corresponding to the first and the second manipulation members 3 and 4, respectively.

Figure 7:
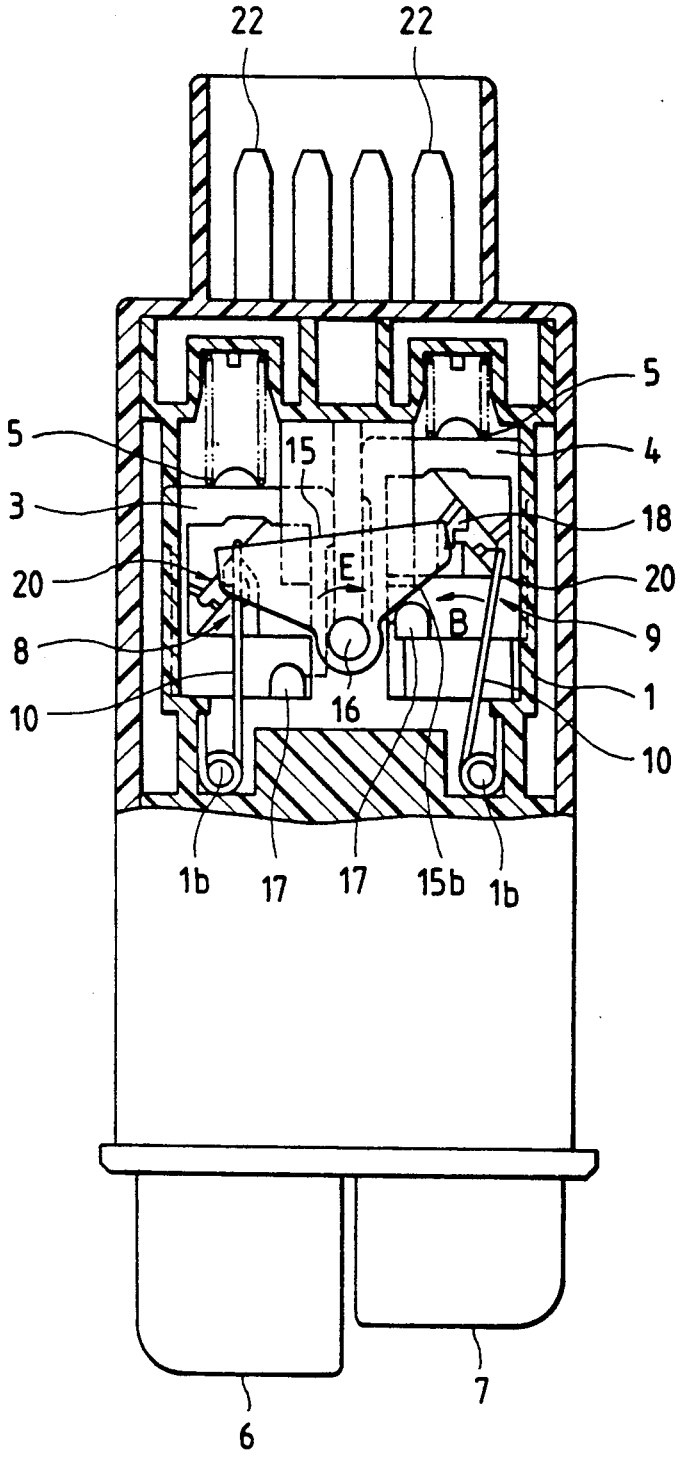
FIGS. 7, 8 and 9 are cutaway partial sectional plan views showing the switch in different operational states.

The operation of the switch will now be described in detail. When the push button 7 is pressed as the switch is in a state shown in FIG. 1, the second manipulation member 4 is moved backward so that the contact projection 17 contacts the oblique portion 15*b* of the operating member 15 at the last stage of the movement of the manipulation member to swing the operating member in a direction opposite to the direction of arrow E, as shown in FIG. 7. At the same time, the locking member 10 of the holding mechanism 9 is displaced in a direction opposite to the direction of arrow B. When the pressing of the push button 7 is then ceased, the second manipulation member 4 is slightly moved forward by the force of the compressed helical spring 5 so that the bent portion 10*b* of the locking member 10 of the holding mechanism 9 is engaged with the cam projection 18 to hold the second manipulation member in the pressed-in position as shown in FIG. 8. At that time, the contact projection 17 of the second manipulation member 4 no longer contacts the operating member 15, the contact portion 15*a* of the operating member faces the locking member 10 near the bent portion 10*b* thereof so as to be capable of contacting the locking member near the bent portion thereof, and the switching mechanism 25 corresponding to the second manipulation member is put into action, or electrically conducting, by virtue of sliding contact between the fixed contacts 23 and the movable contacts 24. When the push button 7 is thereafter pressed again as the switch is in a state shown in FIG. 8, the second manipulation member 4 is released from being held by the locking member 10 of the holding mechanism 9 and is then returned to the original position of the manipulation member by the pushing force of the compressed helical spring 5 as shown in FIG. 1. As a result, the switching mechanism 25 corresponding to the second manipulation member 4 is put out of action, or electrically nonconducting, as the fixed contacts 23 and movable contacts 24 are no longer in contact.

When the push button 6 is pressed, the first manipulation member 3 is moved backward and finally held in a pressed-in position by the locking member 10 of the holding mechanism 8, in the same manner as the second manipulation member 4 is. As a result, the switching mechanism 25 corresponding to the first manipulation member 3 is put into action. When the push button 6 is thereafter pressed again, the first manipulation member 3 is returned to the original position in the same manner as the second manipulation member 4 is. As a result, the switching mechanism 25 corresponding to the first manipulation member 3 is put out of action.

Even if one of the manipulation members 3 and 4 is pressed with the corresponding push button 6 or 7 as the other of the manipulation members remains held in the pressed-in position, the two switching mechanisms 25 corresponding to the manipulation members are not simultaneously put into action. For example, when the first manipulation member 3 is pressed as the second manipulation member 4 remains held in the pressed-in position as shown in FIG. 8, the contact projection 17 of the first manipulation member 3 contacts the oblique portion 15*b* of the operating member 15 at the last stage of the backward movement of the manipulation member 3 so that the operating member is swung in the direction shown by arrow E in FIG. 10 to flex the locking member 10 of the holding mechanism 9 in the direction opposite to the direction shown by arrow B, as shown in FIG. 9. As a result, the bent portion 10*b* of the locking member 10 is disengaged from the cam projection 18 of the second manipulation member 4 so that the second manipulation member 4 is forcibly removed from the pressed-in position without the normal releasing operation performed through a path shown by the arrow f in FIG. 4. Consequently, the second manipulation member 4 is automatically returned to the original position by the force of the compressed helical spring 5 so that the switching mechanism 25 corresponding to the second manipulation member is put out of action. After that, the first manipulation member 3 is held in the pressed-in position by the locking member 10 of the holding mechanism 8 so that the switching mechanism 25 corresponding to the first manipulation member is put into action. Therefore, the two switching mechanisms 25 corresponding to the first and the second manipulation members 3 and 4 are never simultaneously put into action.

When the first and the second manipulation members 3 and 4 are simultaneously pressed with the push buttons 6 and 7, the contact projections 17 of the manipulation members push the oblique portions 15*b* of the operating member 15 in opposite other directions so that the pushing forces acting in the direction shown by arrow E and that reverse thereto balance each other. For that reason, the manipulation members 3 and 4 ar not moved to the pressed-in positions thereof but have their backward movement stopped in front of the pressed-in positions. The two switching mechanisms 25 for the manipulation members 3 and 4 are thus kept out of action, namely, prevented from being simultaneously put into action.

Figure 3:
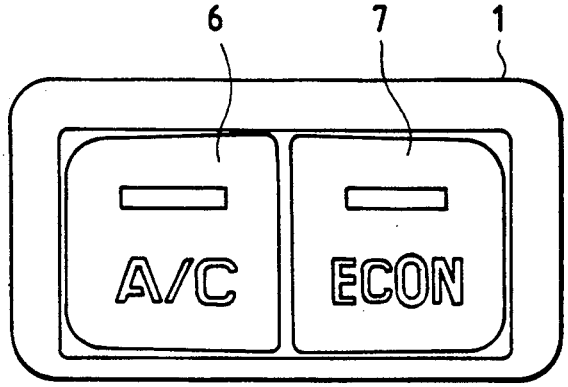
FIG. 3 is a front view showing the switch.

For example, the push buttons 6 and 7 for the first and the second manipulation members 3 and 4 have indications "AC" and "ECON", respectively, as shown in FIG. 3, so that an air conditioner performs normal operation when the first manipulation member is pressed in to put the corresponding switching mechanism 25 into action and that the air conditioner performs economical operation when the second manipulation member is pressed in to put the corresponding switching mechanism 25 into action.

When the push button 7 locked in a pressed-in position as shown in FIG. 8 is pressed again, the bent portion 10*b* of the locking member 10 is returned in a normal path from the surface 20*a* to the surface 20*b* along the wall surface 20*g*, the surface 20*d* and the other wall surface 20*h* as shown by an arrow f in FIG. 4. The rear half of the locking member 10 does not contact the contact portion 15*a* of the operating member 15 as the bent portion 10*b* of the locking member is at the surface 20*d*. Even if the operating member 15 is swung in the direction shown by arrow E by pressing the other push button 6 as the bent portion 10*b* of the locking member 10 is at the surface 20*d*, namely, the former push button 7 is not completely returned to the original position thereof, the contact portion 15*a* of the operating member 15 does contact the rear half of the locking member. For that reason, the problem that the locking member 10 is deformed and/or the cam projection 18 is damaged in that situation, as is likely to occur in the switches shown in FIGS. 10 and 11 and disclosed in the publications, is avoided.

The present invention is not confined to the embodiment described above, but may be embodied or practiced in other various ways without departing from the spirit or essential character thereof. For instance, although the operating member 15 rotates in the embodiment described above, the member may slide back and forth as described in the Japanese Utility Model Unexamined Publication No. Sho. 57-99329.

What is claimed is:

1. A switch comprising:

a case;

first and second manipulation members slidably disposed in said case and means for urging said members in a first direction, each of said first and second manipulation members for being pressed in a second direction, opposite from said first direction, and being movable between an actuated position and a released position;

a first switching mechanism operatively connected to said first manipulation member and a second switching mechanism operatively connected to said second manipulation member, whereby each of said first and second switching mechanisms conducts electricity when the corresonding one of said first and second manipulation members is in said actuated position;

first and second cam projections on said first and second manipulation members, respectively;

first and second locking members each swingably fixed to said case and respectively contacting said first and second cam projections of said first and second manipulation members, said first and second locking members alternately holding in said actuated position or releasing to said released position the corresponding one of said first and second manipulation members, the position of said manipulation member alternating when said manipulation member is pressed;

first and second guide grooves respectively disposed about said first and second cam projections for guiding a tip portion of the corresponding one of said first and second locking members around the corresponding one of said first and second cams while the corresponding one of said manipulating members moves between said actuated position and said released position, each of said first and second guide grooves including a normal return path and a forced return path; and an operating member movably secured to said case and displaced in repsonse to the pressing of one of said first and second manipulation members for forcibly moving said tip portion of said locking member corresponding to the other of said first and second manipulation members along said forced return path, thereby moving the other of said first and second manipulating members from said actuated position to said released position, wherein said tip portions are prevented from contacting said operating member when said tip portions are located in said normal return path of said first or second guide groove responsive to the pressing of the corresponding one of said first and second manipulation members.

2. The switch according to claim 1, wherein said first and second guide grooves each includes a first part in which said tip portion of the corresponding one of said locking members i disposed when the corresponding one of said manipulating members is in said released position, and a second part including said forced return path and in which said tip portion of the corresponding one of said locking members is disposed when the corresponding one of said manipulating members is in the actuated position, said first part having a predetermined depth, said normal return path having a depth less than said first part, and said second part having a depth less than that of said normal return path.

3. The switch according to claim 1, wherein said first and second switching mechanisms each comprise at least one movable contact disposed on the corresponding one of said first and second manipulation members and at least one fixed contact, said at least one movable contact conductiveyl contacting the corresponding one of said at least one fixed contact when the corresponding one of said manipulation members is in said actuated position.

4. The switch according to claim 2, wherein said first and second switching mechanisms each comprise at least one movable contact disposed on the corresponding one of said first and second manipulation members and at least one fixed contact, said at least one movable contact conductively contacting the corresponding one of said at least one fixed contact when the corresponding one of said manipulation members is in said actuated position.

5. The switch according to claim 1, wherein said first and second manipualtion members are operatively connected to a first and second push button, respectively, said first and second manipulation members being pressed by the pressing of the corresponding one of said first and second push buttons.

6. The switch according to claim 2, wherein said first and second manipulation members are operatively connected to a first and second push button, respectively, said first and second manipulation members being pressed by the pressing of the corresponding one of said first and second push buttons.

7. The switch according to claim 4, wherein said first and second manipulation members are operatively connected to a first and second push button, respectively, said first and second manipulation members being pressed by the pressing of the corresponding one of said first and second push buttons.

8. The switch according to claim 1, wherein said operating member is rotatably secured to said case.

9. The switch according to claim 2, wherein said operating member is rotatably secured to said case.

10. A switch comprising:

a case;

first and second manipulation members slidably disposed in said case and means for urging said members in a first direction, each of said first and second manipulation members for being pressed in a second direction, opposite from said first direction, and being movable between an actuated position and a released position;

a first switching mechanism operatively connected to said first manipulation member and a second switching mechanism operatively connected to said second manipulation member, whereby each of said first and second switching mechanisms conducts electricity when the corresponding one of said first and second manipulation members is in said actuated position;

first and second cam projections on said first and second manipulation members, respectively;

first and second locking members each swingably fixed to said case and respectively contacting said first and second cam projections of said first and second manipulation members, said first and second locking members alternately holding in said actuated position or releasing to said released position the corresponding one of said first and second manpulation members, t he position of said manipulation member alternating when said manipulation member is pressed;

first and second guide grooves respectively disposed about said first and second cam projections for guiding a tip portion of the corresponding one of said first and second locking members around the corresponding one of said first and second cams while the corresponding one of said manpulating members moves between said actuated position and said released position, each of said first and second guide grooves including a normal return path and a forced return path; and an operating member rotatably secured to said case and displaced in response to the pressing of one of said first and second manipulation members for forcibly moving said tip portion of said locking member corresponding to the other of said first and second manipulation members along said forced return path, thereby moving the other of said first and second manipulating members from said actuated position to said released position.

* * * * *

UNITED STATES PATENT AND TRADEMARK OFFICE

CERTIFICATE OF CORRECTION

PATENT NO. : 5,187,335

DATED : February 16, 1993

INVENTOR(S) : Takahiko Fukuyama et al.

It is certified that error appears in the above-identified patent and that said Letters Patent is hereby corrected as shown below:

Title Page:

Abstract, item [57] line 3, before "two locking members" insert --,--;
line 10, change "paths" to --path--;
line 12, change "damages" to --damage--.

Claim 1, column 8, line 56, change, "corresonding" to --corresponding--.

Claim 1, column 9, line 14, change "repsonse" to --response--.

Claim 2, column 9, line 31, change "i" to --is--.

Claim 3, column 9, line 46, change "conductiveyl" to --conductively--.

Claim 5, column 9, line 61, change "manipualation" to --manipulation--.

Claim 10, column 10, line 43, change "manpulation" to --manipulation--.

Claim 10, column 10, line 43, change "t he" to --the--.

UNITED STATES PATENT AND TRADEMARK OFFICE

CERTIFICATE OF CORRECTION

PATENT NO. : 5,187,335

DATED : February 16, 1993

INVENTOR(S) : Takahiko Fukuyama et al

It is certified that error appears in the above-indentified patent and that said Letters Patent is hereby corrected as shown below:

Claim 10, column 10, line 51, change "manpulating" to --manipulation--.

Signed and Sealed this

Eleventh Day of January, 1994

Bruce Lehman

*Attest:*

BRUCE LEHMAN

*Attesting Officer*

*Commissioner of Patents and Trademarks*